US006449901B1

(12) United States Patent
Gibree et al.

(10) Patent No.: US 6,449,901 B1
(45) Date of Patent: Sep. 17, 2002

(54) SECURITY GATE

(75) Inventors: Steven Gibree, Hope, RI (US); Anthony Wong, Franklin, MA (US); Brian Sundberg, Chester; Steven Torosian, Durham, both of NH (US)

(73) Assignee: Safety 1st, Inc., Canton, MA (US)

( * ) Notice: Subject to any disclaimer, the term of this patent is extended or adjusted under 35 U.S.C. 154(b) by 0 days.

(21) Appl. No.: 09/587,308

(22) Filed: Jun. 5, 2000

(51) Int. Cl.[7] ..... E06B 3/68
(52) U.S. Cl. ..... 49/57; 49/55; 49/465
(58) Field of Search ..... 49/50, 55, 57, 49/463, 465; 160/224, 225, 228

(56) References Cited

U.S. PATENT DOCUMENTS

| | | | | |
|---|---|---|---|---|
| 1,662,167 A | | 3/1928 | Rexinger | |
| 1,849,024 A | | 3/1932 | McKee | |
| 1,923,804 A | | 8/1933 | Williams et al. | |
| 2,436,344 A | | 2/1948 | Winogrond | |
| 2,982,353 A | | 5/1961 | Luger | |
| 3,000,063 A | | 9/1961 | Hoog | |
| 3,163,205 A | | 12/1964 | Gottlieb | |
| 3,489,201 A | | 1/1970 | Curry, III et al. | |
| 4,149,342 A | | 4/1979 | Bowers | |
| 4,465,262 A | | 8/1984 | Itri et al. | |
| 4,607,445 A | | 8/1986 | Bluem et al. | |
| 4,846,246 A | | 7/1989 | Stern | |
| 4,944,117 A | | 7/1990 | Gebhard et al. | |
| 4,968,071 A | | 11/1990 | Stern | |
| 5,052,461 A | | 10/1991 | Stern | |
| 5,272,840 A | | 12/1993 | Knoedler et al. | |
| 5,367,829 A | | 11/1994 | Crossley et al. | |
| 5,437,115 A | | 8/1995 | Freese et al. | |
| 5,442,881 A | | 8/1995 | Asbach et al. | |
| 5,528,859 A | | 6/1996 | Taylor et al. | |
| 5,535,552 A | | 7/1996 | Stern | |
| 5,570,543 A | * | 11/1996 | Bishop | 49/55 X |
| 5,782,039 A | | 7/1998 | Scherer et al. | |
| 5,906,068 A | * | 5/1999 | Bode | 49/465 X |
| 5,924,242 A | | 7/1999 | Macari et al. | |
| 6,112,461 A | * | 9/2000 | Cheng | 49/465 X |

FOREIGN PATENT DOCUMENTS

| | | |
|---|---|---|
| AU | 211486 | 11/1956 |

* cited by examiner

*Primary Examiner*—Jerry Redman
(74) *Attorney, Agent, or Firm*—Wolf, Greenfield & Sacks, P.C.

(57) ABSTRACT

A security gate for closing a passage has a pair of panels movable translationally with respect to one another to alter the effective width of the gate. An actuating mechanism for forcing the opposite ends of the panels against the sides of the passage includes a handle mounted on one of the panels controlling a latching device operative for locking the handle in a fixed relationship with respect to the other of the panels. The latching device in accordance with one embodiment includes a rack and brake. When the latch is engaged, a cam also controlled by the handle engages the panel on which the handle is mounted to force the two panels translationally further apart so as to bear firmly against the sides of the passage to hold the gate in position.

19 Claims, 12 Drawing Sheets

SECURITY GATE

FIELD OF THE INVENTION

This invention relates to security gates for children and pets and more particularly to pressure mounted security gates that may conveniently and easily be mounted and released in a variety of different passageways such as stairways, doors and halls.

BACKGROUND OF THE INVENTION

Presently there are two common types of adjustable, pressure mounted, security gates that are used in the home for children and pets that have a plurality of panels that are roughly adjusted to fill the passageway in which they are to be used. One type has extendible bumpers on at least one side to firmly engage the side or sides of the passageway to hold the gate in place and the second type that has fixed bumpers on the panels that are caused to firmly engage the sides of the passageway by forcibly extending the panels in opposite directions and locking them in the maximum extended position. The present invention is of the later type.

An object of the present invention is to provide a pressure mounted security gate that with a single motion can establish a gross adjustment for the two panels of the gate and force the gate panels to move an incremental further distance to firmly press the bumpers against the passageway sides and lock the panels in fixed relationship to one another.

Another object of this invention is to provide a memory feature into the gate for quick and easy reinstallation in a passageway.

Another object of this invention is to provide a relatively inexpensive gate that provides the security of more expensive gates.

SUMMARY OF THE INVENTION

In one aspect of the present invention the security gate has a plurality of panels that are slidably assembled together so that their combined effective width may be varied to form a barrier for closing passageways of different width. The outside edges of the end panels facing away from one another carry one or more bumpers for engaging the opposed sides of the passageway. An actuating mechanism slidably mounted on one of the panels has a locking device that fixes the mechanism to another of the panels after the panels have been partially actuated to establish a gross adjustment of the gate width. Thereafter, further actuation of the mechanism causes the said one of the panels to move with respect to the other panels so as to establish a fine adjustment of the gate width wherein the bumpers are firmly pressed against the sides of the passageway to hold the gate in place. In accordance with another aspect of the invention, a seat is provided for the actuating mechanism so as to maintain the gross adjustment for the gate width so that it may quickly be reinstalled in the same passageway without having to make the gross adjustment.

DETAILED DESCRIPTION

Figure 1:
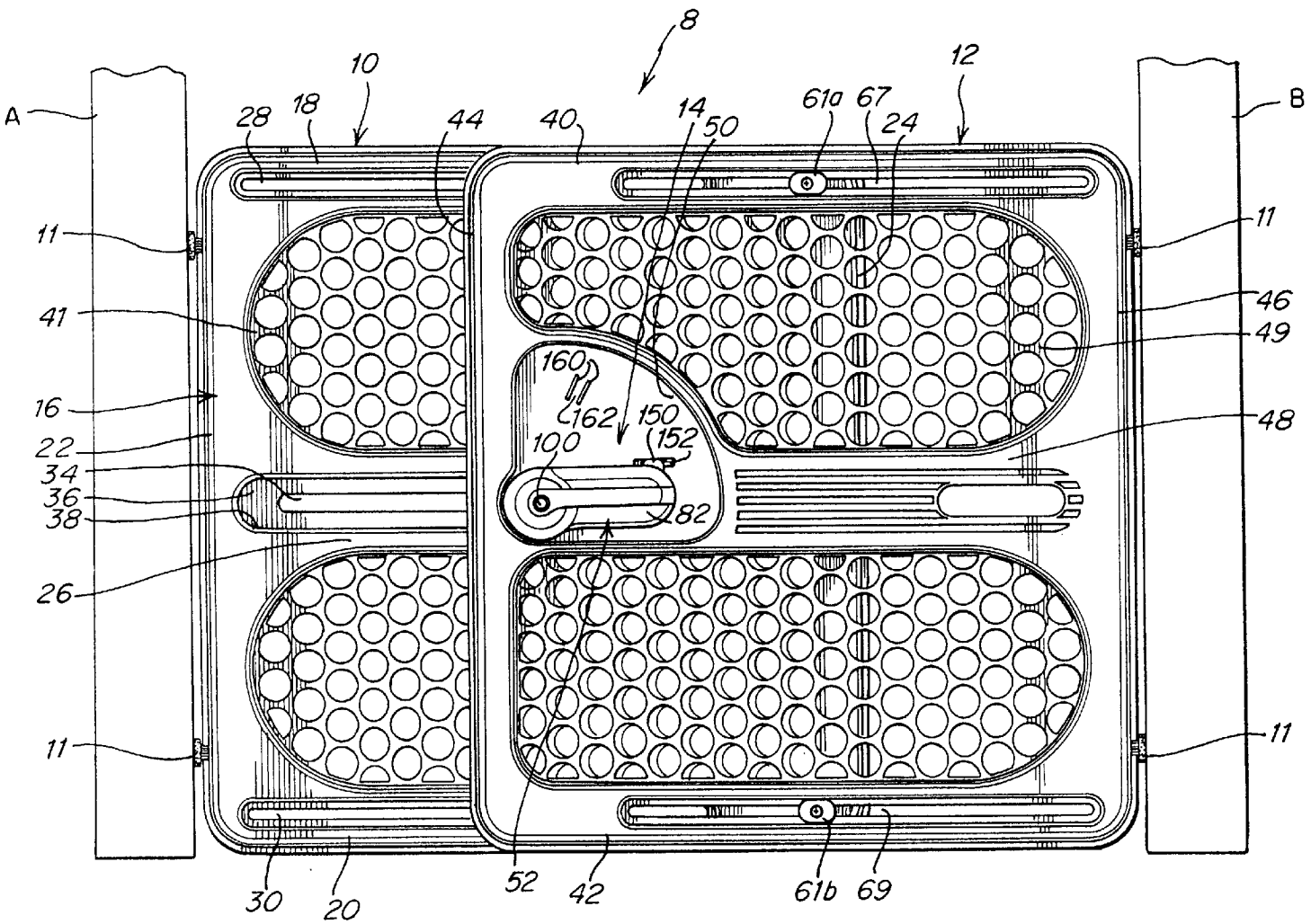
FIG. 1 is a front elevation view of one embodiment of a child's security gate constructed in accordance with this invention.
Figure 2:
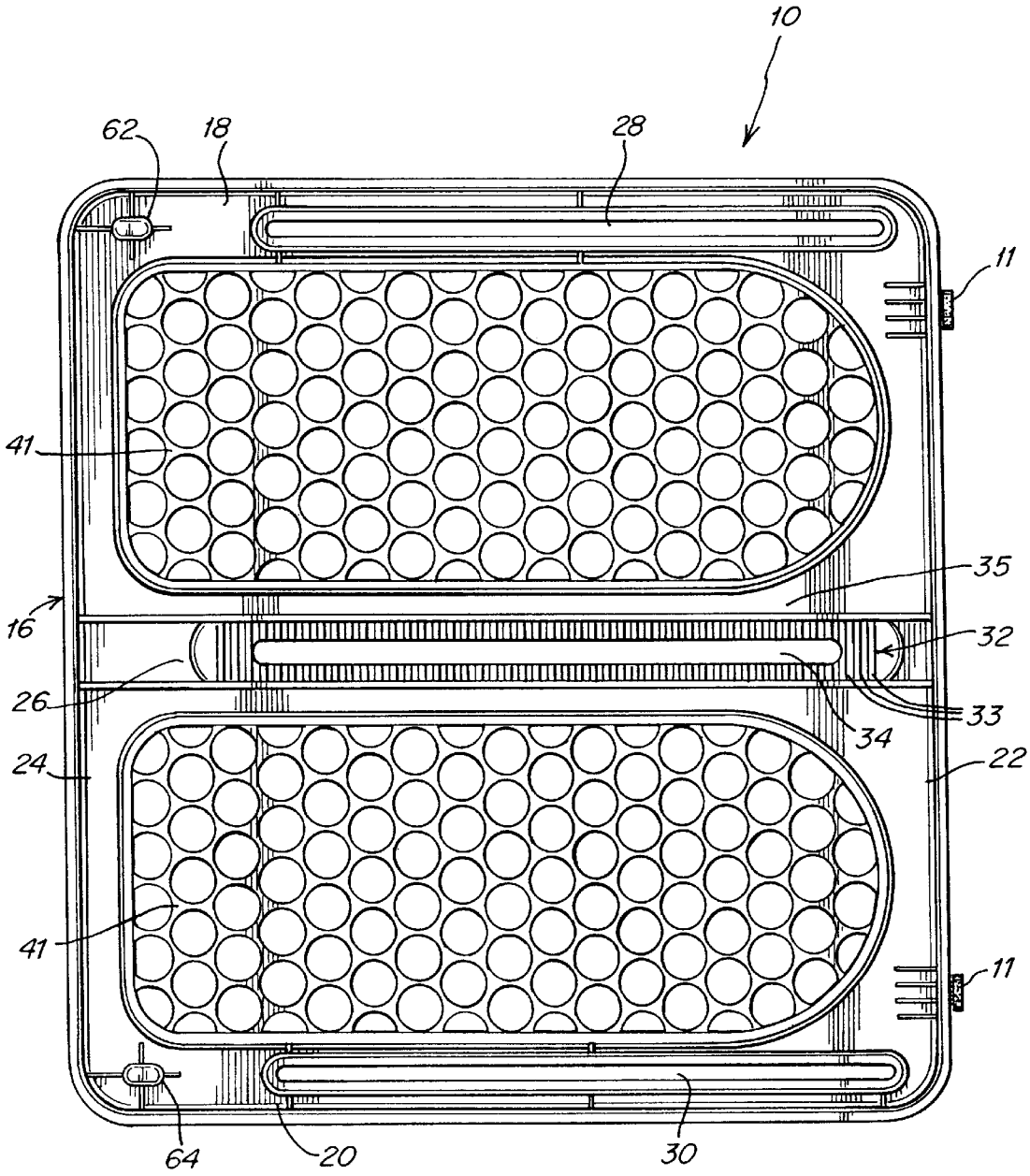
FIG. 2 is a rear elevation view of the rear panel of the gate of FIG. 1.

The security gate 8 of the present invention is shown in FIG. 1 disposed in a passageway defined by a pair of side walls A and B. The passageway is effectively closed by slidably expanding the effective width of the gate 8 so that the bumpers 11 mounted on the outside edges of the gate are compressed firmly against the sides A and B. One or more bumpers may be employed on each of the outside edges. The gate of the present invention generally includes a rear panel 10, front panel 12 and actuating mechanism 14. The details of the various parts of the gate are described below.

The rear panel 10 of the present invention in the embodiment shown is molded of a suitable plastic such as styrene and includes a frame 16 having top and bottom horizontal members 18 and 20 and vertical side members 22 and 24. A horizontal cross member 26 extends between the side members 22 and 24 essentially midway between the top and bottom frame members 18 and 20.

Figure 3:
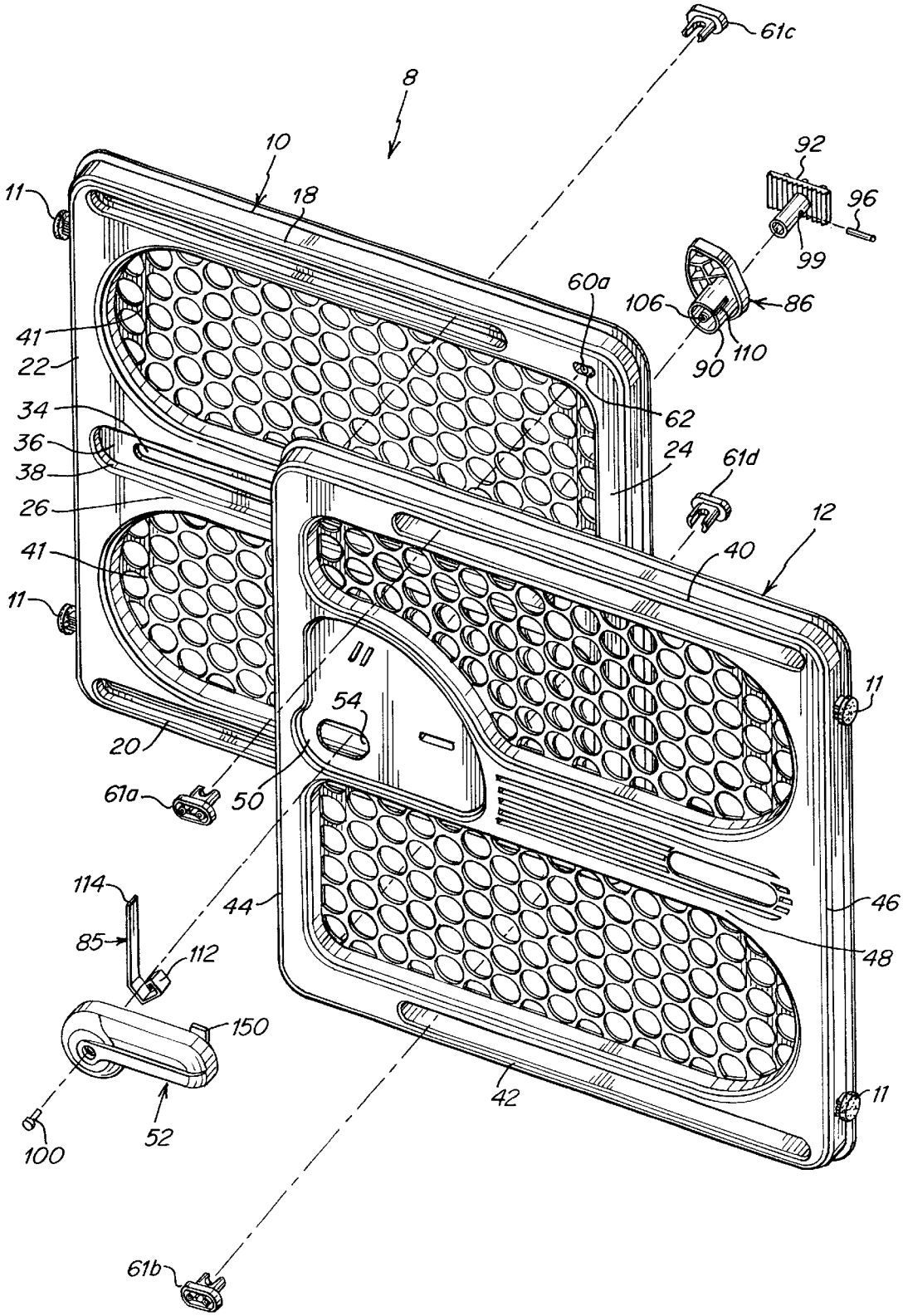
FIG. 3 is an exploded front perspective view of the embodiment of the security gate shown in FIG. 1.
Figure 4:
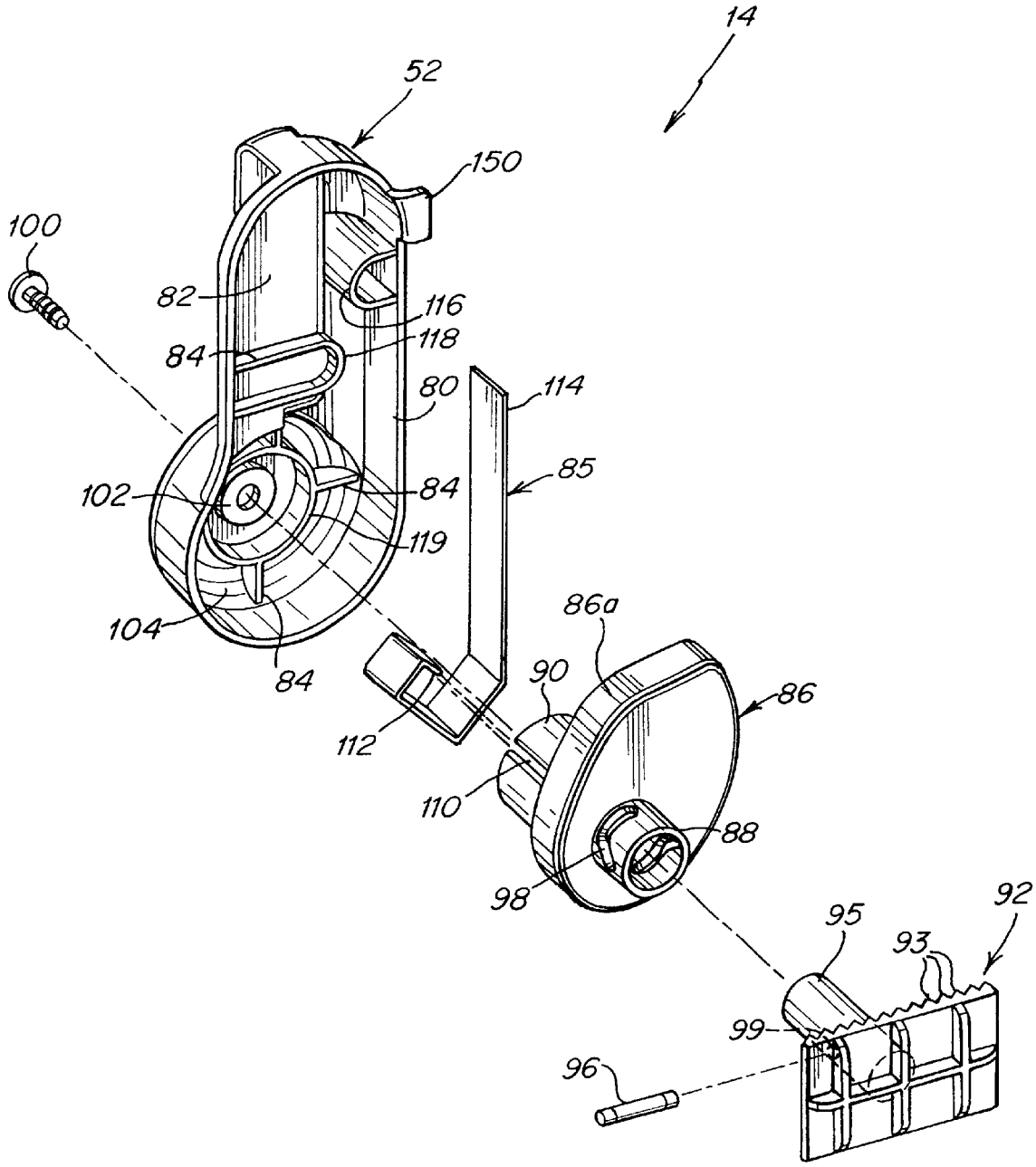
FIGS. 4 and 4A are enlarged exploded perspective views of the actuating mechanism of the gate shown in FIGS. 1 and 3.
Figure 4A:
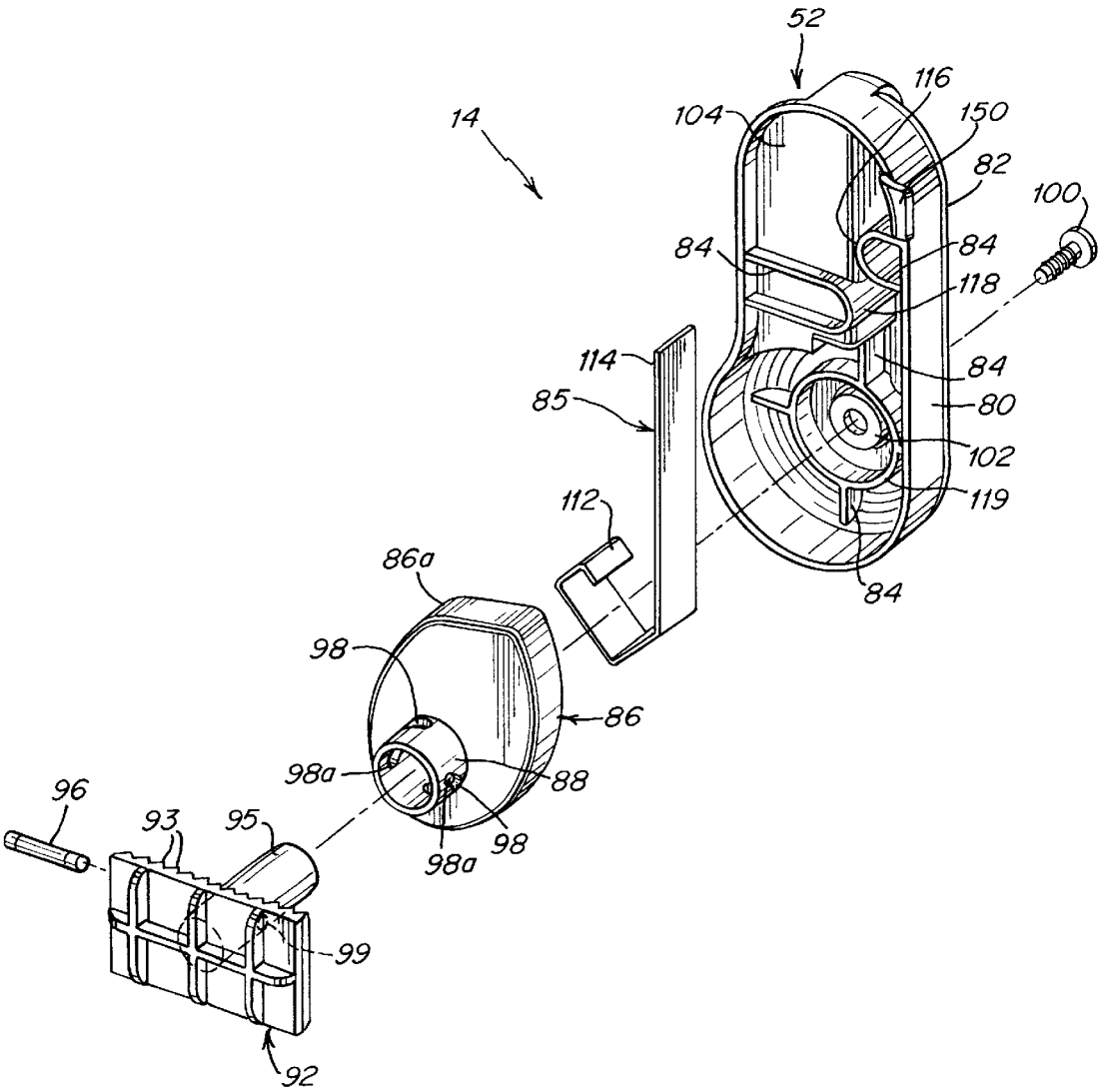
Figure 5:
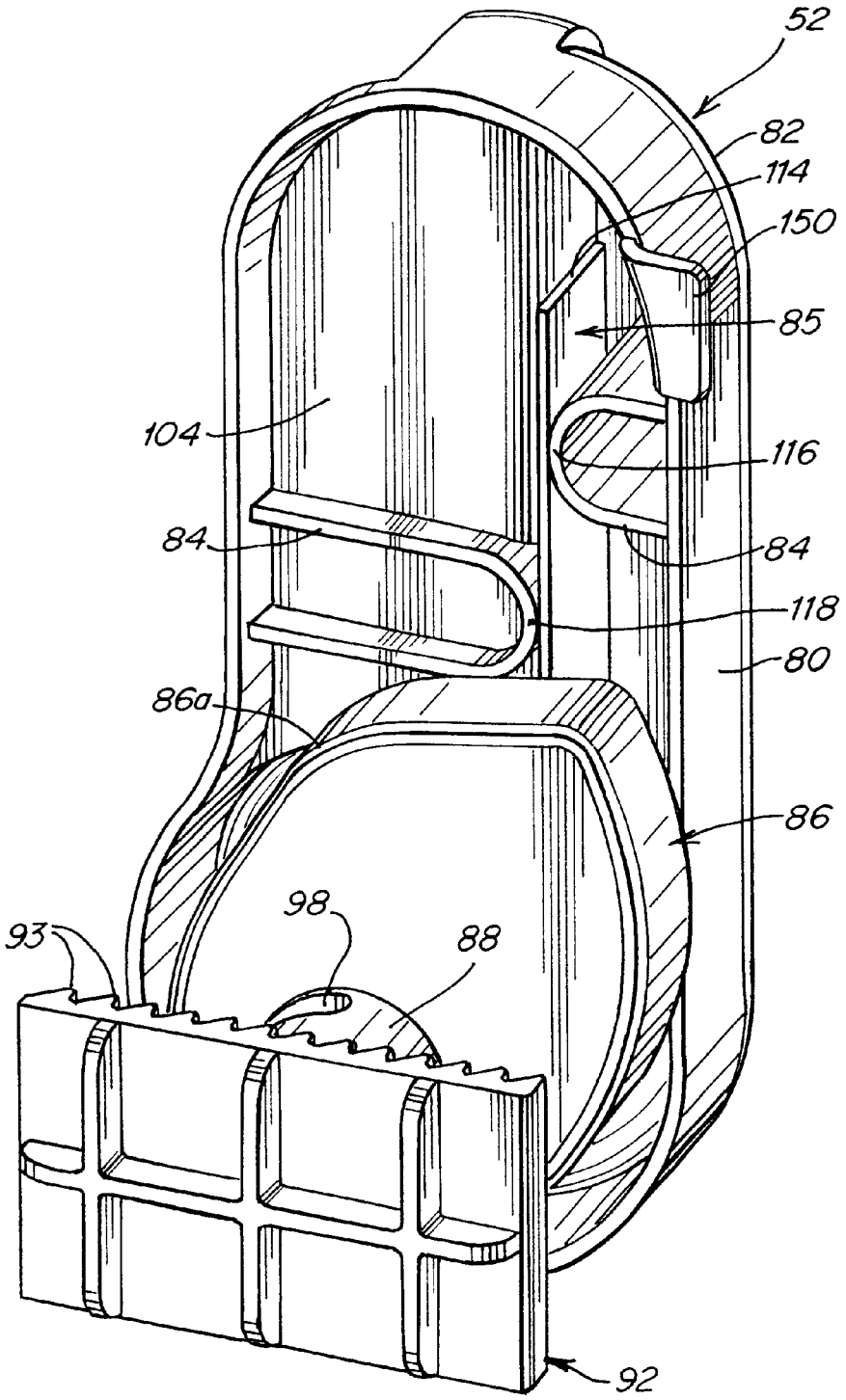
FIG. 5 is a perspective view of the handle, cam and brake forming part of the actuating mechanism.
Figure 10:
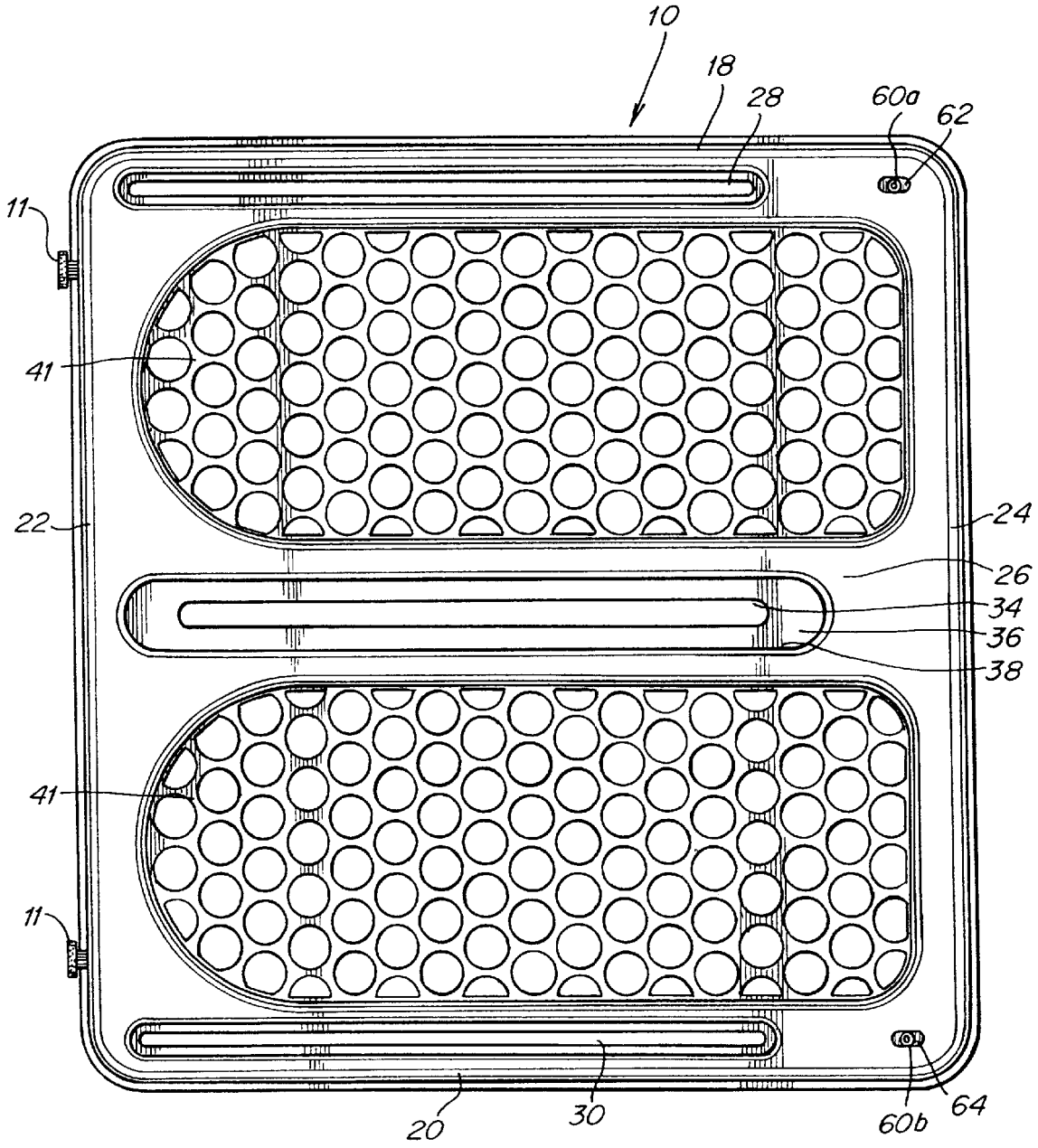
FIG. 10 is a front elevation view of the rear panel of the gate.

Horizontal slots 28 and 30 are provided in the top and bottom members 18 and 20 that form part of the slide mechanism that enables the front and back panels 12 and 14 to move translationally with respect to one another when the effective width of the gate is expanded or contracted. That mechanism is described in detail below. A rack 32 extends along the rear surface 32 of the horizontal cross member 26 with its teeth 33 disposed both above and below slot 34. The rack 32 and slot 34 are substantially coextensive with one another. A recess 38 extends substantially the full length of the cross member 26 on the front side of the panel and the slot 34 is open through the bottom wall 36 thereof. (See FIGS. 1, 3 and 10). Open mesh screening 41 molded as an integral part of the panel 10 fills the gaps between the cross member 26 and the top and bottom members 18 and 20 so that the panel 10 may serve as a complete barrier for a child or animal. Typically, each of the panels 10 and 12 is approximately 25 inches wide and 27 inches tall but of course for different passageways other sizes may be appropriate.

Figure 9:
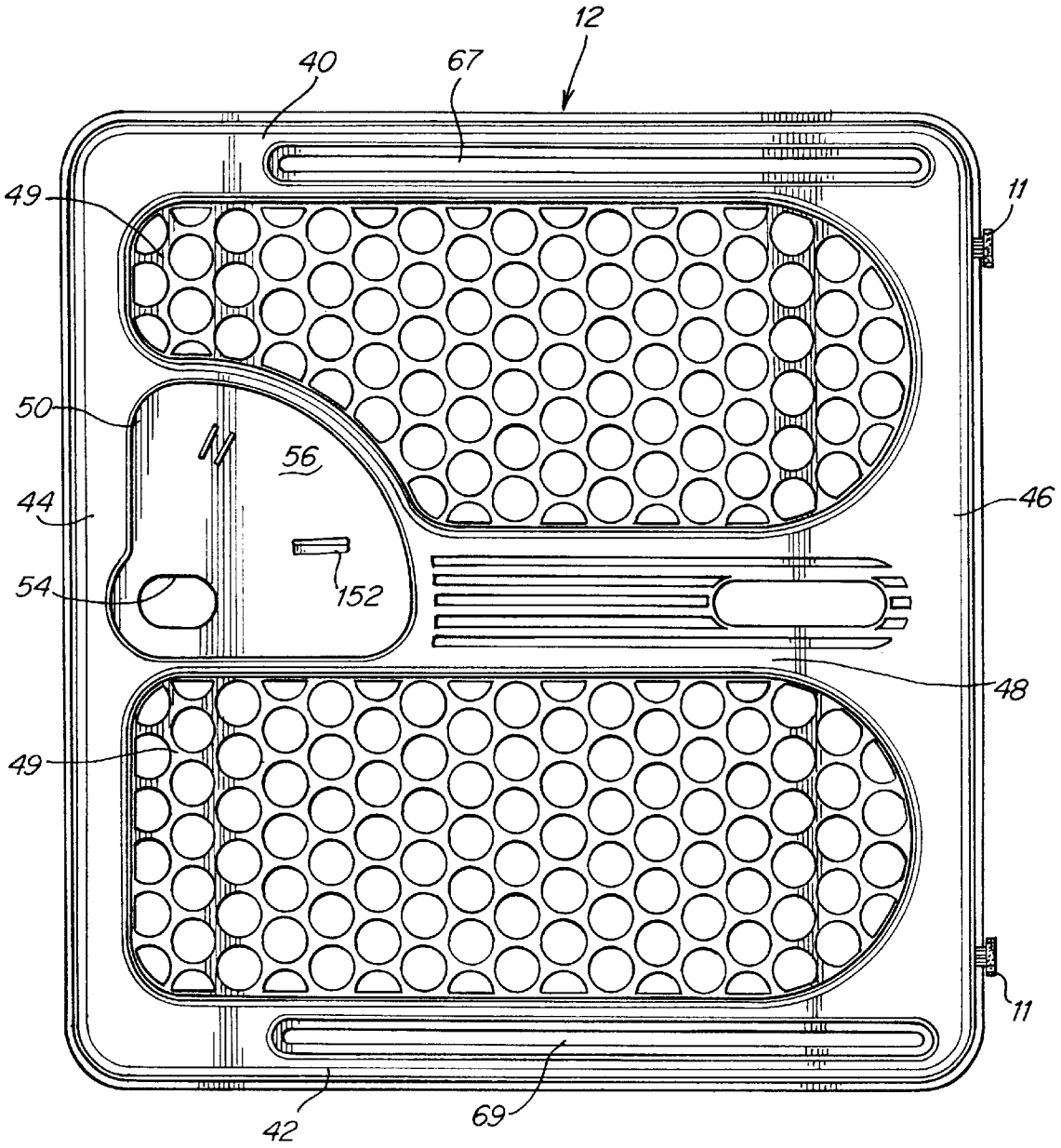
FIG. 9 is a front elevation view of the front panel of the gate.

Front panel 12 like the rear panel 10 also has a rectangular frame composed of top and bottom frame members 40 and 42, vertical side members 44 and 46, horizontal cross member 48 disposed midway between the top and bottom members 40 and 42 and open mesh screening 49. The cross member 48 has a generally quadrant shaped recess 50 on its front face at its left end as viewed in FIGS. 1 and 9 within which the handle 52 of the actuating mechanism 14 moves. An elongated slot 54 is provided in the bottom wall 56 of the recess 50 through which the handle 52 is connected to other parts of the actuating mechanism that lie between the panels 10 and 12 and behind the rear face of the rear panel. The elongated slot 54 also permits limited horizontal translational motion of the front panel 12 relative to the actuating mechanism 14.

Figure 11:
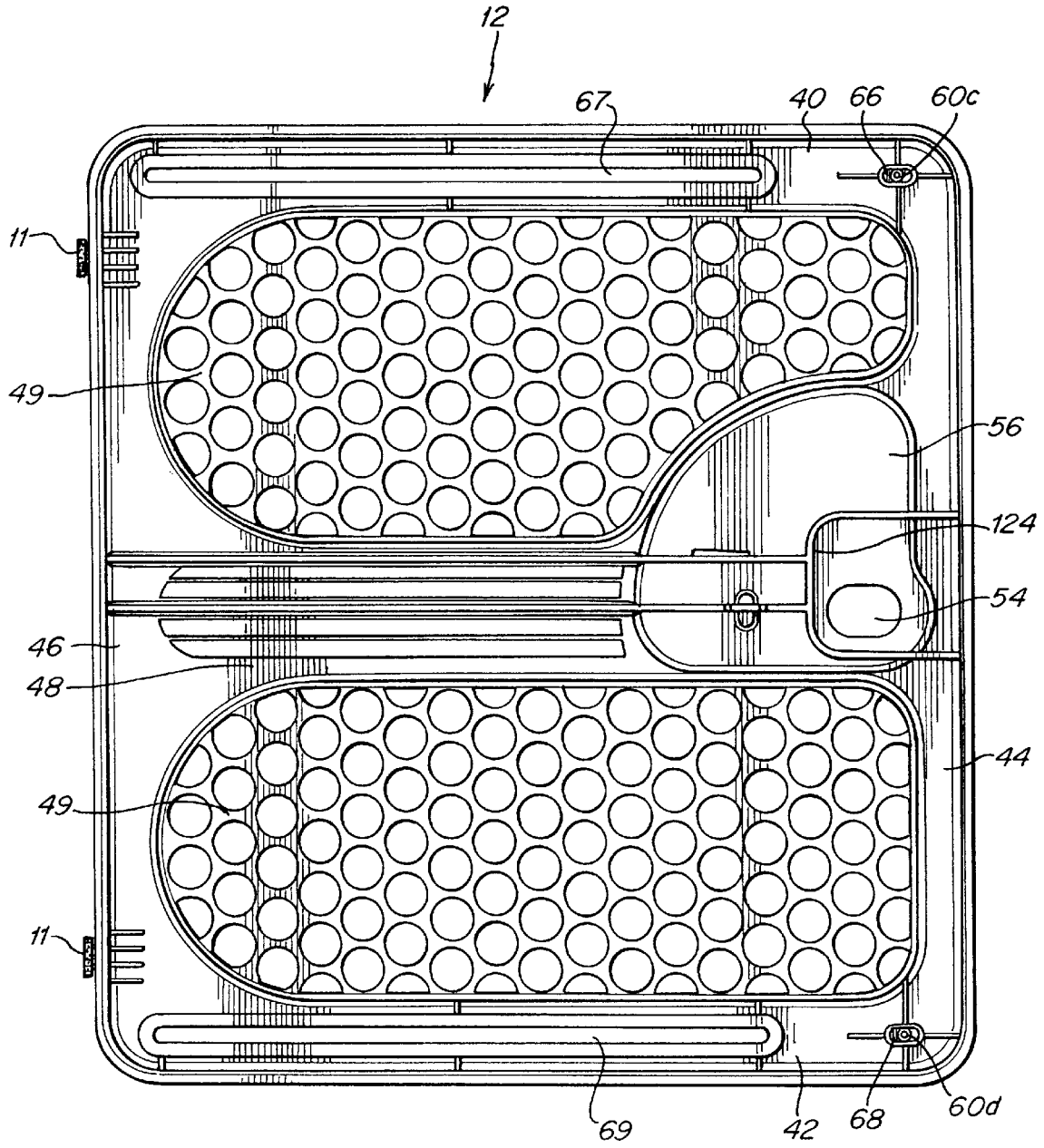
FIG. 11 is a rear elevation view of the front panel of the gate.

The panels 10 and 12 are slidably connected together by retainers 60*a, b, c*, and *d* that are disposed in recesses 62 and 64 provided on the front face of the panel 10 (see FIG. 10) and recesses 66 and 68 provided in the rear face of panel 12 (see FIG. 11). The recesses 62, 64, 66, and 68 are respectively aligned with the slots 28, 30, 67, and 69 respectively in the horizontal members 18, 20, 40 and 42 of the frames of the rear and front panels. The retainers 60*a* and 60*b* carried on the rear panel 10 extend through the slots 67 and 69 in the front panel 12 and are secured to slides 61*a* and 61*b* that are disposed on the front face of the front panel. Similarly, retainers 60*c* and 60*d* extend through the slots 28 and 30 on the rear panel and connect to slides 61*c* and 61*d* on the rear face of the rear panel. Thus, the two panels are slidably connected to one another and are maintained in horizontal alignment. The slides 61 are sized so as not to bind on the faces of the panels, but rather slide rather freely on them so as to permit the panels to move from a contracted position wherein the left and right frame members of the panels are in alignment to an extended position wherein the left vertical frame member 22 of the rear panel and the right vertical frame member 46 of the front panel are a maximum distance apart.

While in the foregoing paragraphs gate panels 10 and 12 of the embodiment illustrated have been described in detail, it should be appreciated that the panels may be made of other materials such as wood or metal and they may be slidably connected together by a variety of different arrangements. For example, the slidable connections could be in the form of brackets that span both the top and bottom edges of the panels as opposed to the slots and retainers and slides used in the illustrated embodiment.

In FIGS. 3, 4, 4A and 5, the actuating mechanism is shown. Handle 52 includes a peripheral wall 80 and a front wall 82 along with a number of stiffening ribs 84 30 contained within the cavity 104 defined by the peripheral and front walls. The actuating mechanism also includes a compliance spring 85, cam 86 having a collar 88 on its rear face and a hub 90 on its front face, and a brake 92. The cam 86 is disposed between the two panels 10 and 12 and the brake is disposed on the rear side of the back panel 10. The brake 92 in turn has a hub 95 that has a pair of diametrically aligned holes 99 that support a pin 96 that rides in cam slots 98 in the collar 88 on the cam. The cam 86 is connected to the handle 52 by means of a sonic nail 100 that extends through a hub 102 formed on the rear face of the handle in the cavity 104 and engages a sleeve 106 (see FIG. 3) within the hub 90 on the front wall of the cam. The nail 96 permits the handle 52, cam 86 and brake 92 to rotate with respect to one another.

Hub 90 of the cam 86 also has an axially extending slot 110 that receives the hook end 112 of leaf spring 85 while the other end 114 of the spring is held in place in the handle by the U-shaped ribs 116 and 118. The hook end 112 of the spring extends over the circular wall 119 in the inside of the handle and sits in the proper position so as to register with the slot 110 in the hub 90. The collar 90 of the cam extends through the elongated slot 54 in the recess 50 on the front panel 12 so as to engage the hub 102 within circular wall 116 of the handle. The connections between the handle and the cam 15 and between the cam and the brake cause separate actions to occur in sequence when the handle is turned clockwise from the vertical position in the recess 50 shown in FIG. 6, through 90° to the horizontal position as shown in FIG. 8.

In FIG. 11, it will be noted that an arcuate cam follower 124 is carried on the rear surface of front panel 12 adjacent the horizontal slot 54. As described below, the cam follower cooperates with the cam to force the panels 10 and 12 outwardly with respect to one another.

Figure 6:
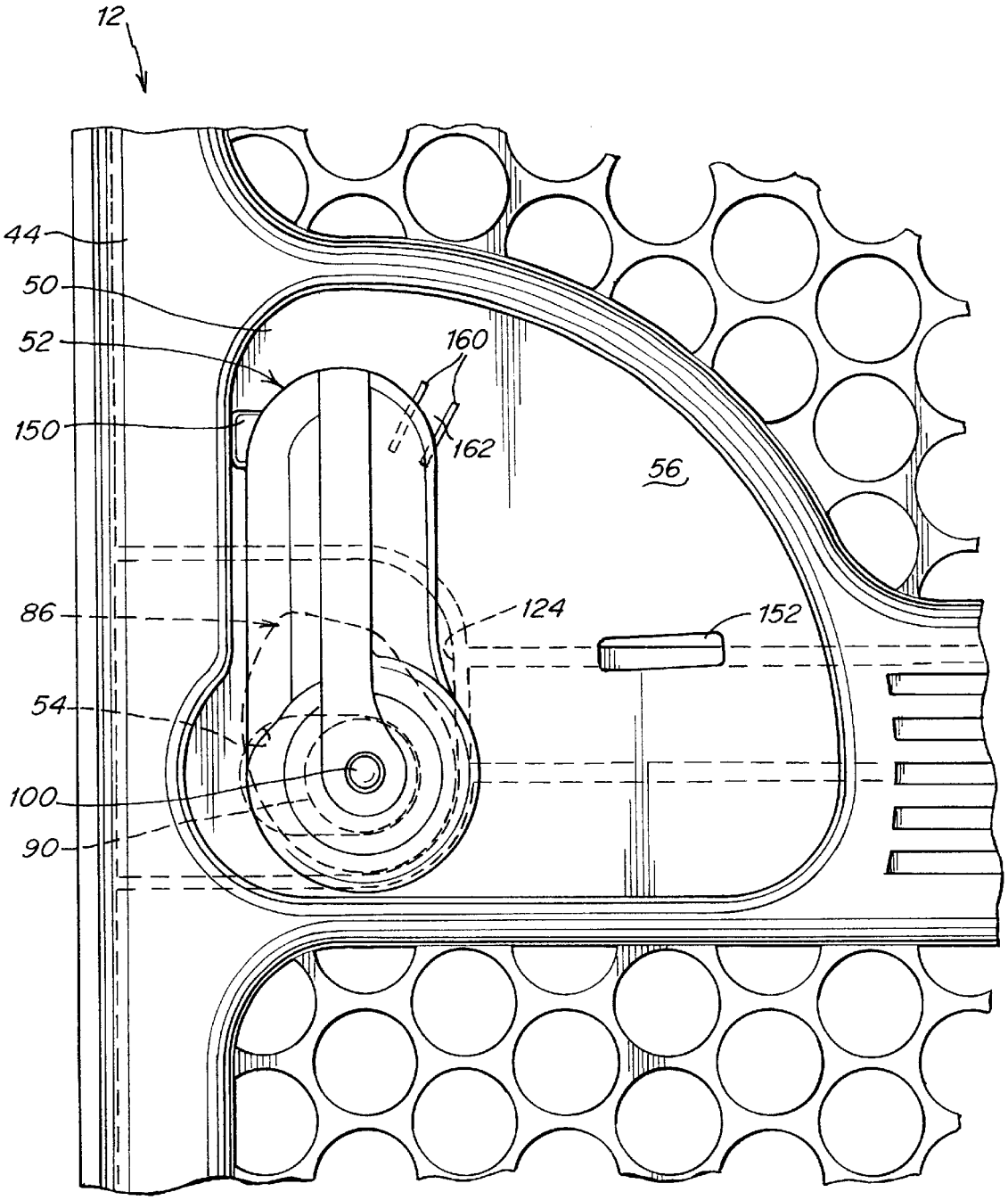
FIG. 6 is a fragmentary elevation view showing the handle of the actuating mechanism in its release position wherein the two gate panels are free to move relative to one another.
Figure 7:
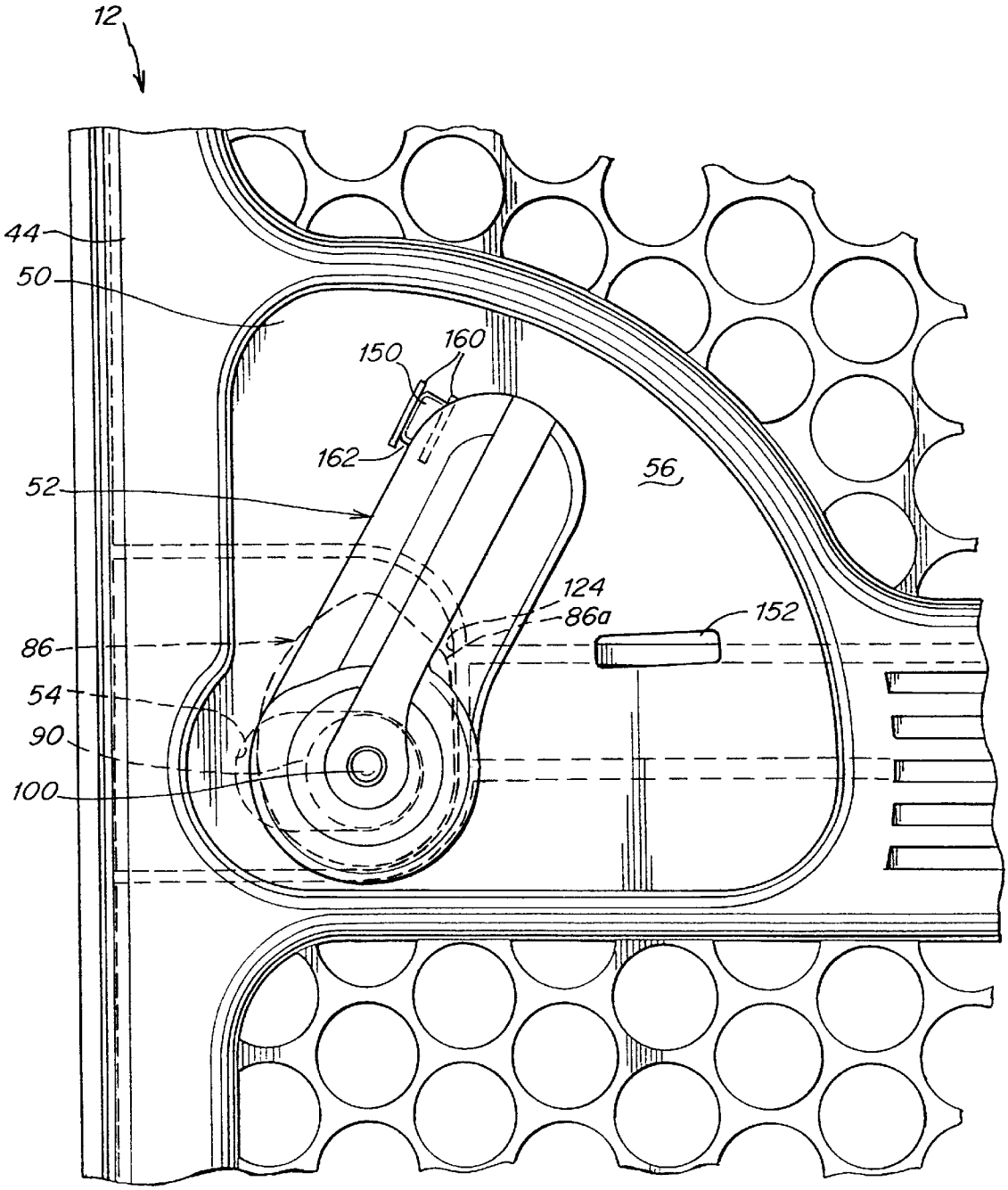
FIG. 7 is a view similar to FIG. 6 but showing the handle in its intermediate position when the actuating mechanism has locked the handle to the rear panel of the security gate.
Figure 8:
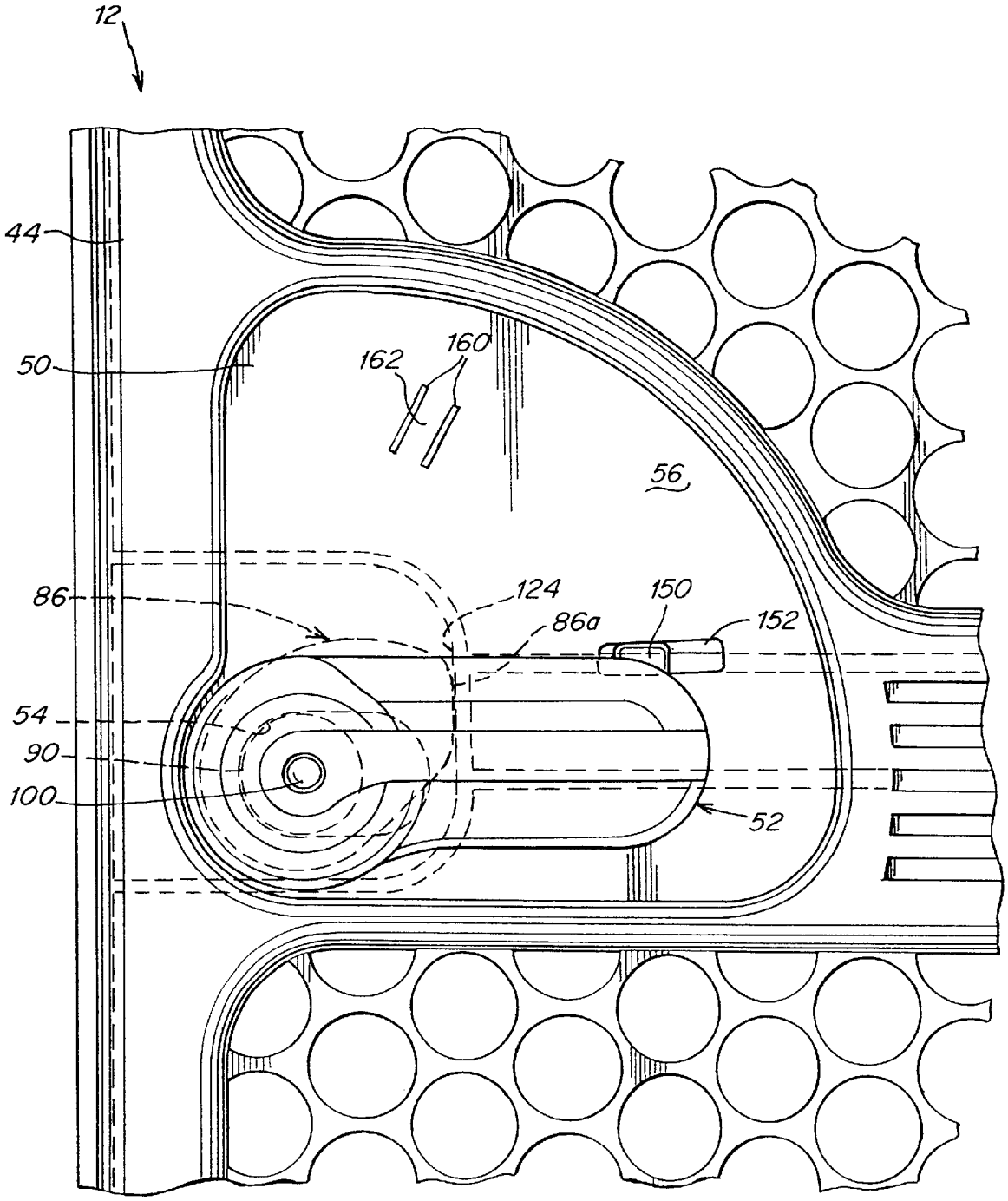
FIG. 8 is a front elevation view similar to FIGS. 6 and 7 showing the handle in its locked position wherein the gate is immobilized in a passageway to close it.

As suggested above, two independent separate actions occur when the handle is moved from the vertical position of FIG. 6 to the horizontal position shown in FIG. 8. In the vertical position, the pin 96 carried by the hub 95 extending forwardly from the main body of the brake 92 is disposed in the rearwardmost ends 98*a* of the cam slots 98 in the hub 88 of cam 86, and the body of the brake 92 therefore is in its rearwardmost position, and its teeth 93 are out of engagement with the teeth 32 of the rack 34 on the back face of rear gate panel 10. Therefore, the two panels 10 and 12 are free to slide translationally with respect to each other so that the effective widths of the gate made up of the two 30 panels may be enlarged or reduced. When the handle 52 is turned through approximately 30° in a clockwise direction to the position of FIG. 7, the pin 96 will be drawn by the cam slots 98 in a forward direction toward the rear face of the back panel 10 until the brake teeth 93 engage the teeth 32 of the rack 34 and lock the brake and rack in fixed position with respect to one another. When that occurs, the handle 52 and cam 86 and more particularly their common rotational axis is fixed with respect to the rear panel. When the handle is turned further in a clockwise direction to the position of FIG. 8, the peripheral cam surface 86*a* of cam 86 will engage the cam follower 124 on the rear wide of the front panel and push the front panel 12 to the right with respect to the rear panel 10 as viewed in FIG. 1 so as to cause the panels to spread further apart. Thus, an incremental increase in the effective width of the gate is achieved.

To mount the gate in a passageway, the handle 52 is placed in a vertical position so as to free the brake 92 from the rear panel 10 to allow movement of the panels relative to one another, and the panels are spread apart so that the bumpers 11 carried on the vertical frame members 22 and 46 just touch or almost touch the sides A and B of the passageway. When that gross adjustment in gate width is made, the user then turns the handle in a clockwise direction, which will first lock the brake 92 and the rest of the actuating mechanism including handle 52 and cam in a fixed axial position with respect to the rear panel 10. As the handle 52 is turned further in a clockwise direction, the cam 52 will act on the cam follower 124 to increase the total width of the gate and cause the bumpers 11 to be squeezed against and firmly engage the sides A and B of the passageway. The elongated slot 54 in the front panel 12 through which the hub 90 of the cam extends allows the front panel to move translationally relative to the rear panel 10 and the actuating mechanism 14. When the panels can no longer move outwardly relative to one another (the bumpers are firmly engaged by the sides of the passageway), the handle is forced to the horizontal position until its latching flange 150 is aligned with the latching slot 152 in the well 50 of the front panel. The handle may then be pushed rearwardly so as to cause the flange 150 to enter the slot 152 and thereby releasably lock the handle in that position. In order to compensate for irregularities in the side surfaces A and B of the passageway and further allow the handle to be locked in the horizontal position after the bumpers have firmly engaged the sides A and B, a limited compliance is built into the connection between the handle 52 and the cam 86 by means of the spring 84. It will be appreciated that the handle 52 does not directly drive the cam but rather the handle 52 acts on the cam through the spring 85. Therefore, when the cam can no longer turn because the bumpers of the respective panels have firmly engaged the sides of the passageway some further limited movement is accorded the handle by means of the spring 84 through which the handle 52 drives the cam 86. Thus, the spring will allow the handle to turn through a limited number of degrees after the cam 86 is prohibited from moving further to enable the locking flange 150 to be moved into alignment with the slot 152.

To release the gate from the passageway, the handle need be freed from the locked horizontal position and turned counterclockwise an amount sufficient to relieve the pressure on the bumpers 11. If the gate is to be used repeatedly in the same passageway, the handle should not be turned counterclockwise so far as to free the brake 92 from the rack on the rear panel. The brake 92 engaged with the rear panel 10 prevents appreciable sliding movement of the panels relative to one another, limited merely to the length of the slot 54. To reduce the gate width to a minimum for storage or transport, the handle should be turned to the vertical positions of FIG. 6 so that the frames of two panels may be placed in alignment with one another.

In FIGS. 1, 6, 8 and 9, a pair of ribs 160 are shown on the front panel 12 within recess 56 to define a shallow seat 162 for locking flange 150 on handle 52. The seat may releasably retain the handle in the intermediate position wherein the brake 92 engages the rack on the rear panel 10 so as to main the two panels in the gross adjustment setting and thereby make it easier to remount the gate in the passageway from which it was last used. Obviously use of this handle setting is at the discretion of the person that installs the gate in the passageway.

From the foregoing description it will be appreciated that many modifications may be made in the illustrated embodiment in addition to those suggested above without departing from the spirit of the invention. For example, other well-known expedients such as threads may be provided on the collar 88 and hub 94 of the brake to cause the brake to move axially in response to turning of the handle. Moreover, the gate may be composed of more than two panels and embody this invention. Also, while in the embodiment shown the brake is disposed behind the back panel and the cam is positioned between the panels, the brake may be located between the panels and/or the cam may be disposed on the front side of the front panel. The invention also has application to a gate structure wherein one side edge is mechanically attached such as by a hinge structure to one side of a passageway and the bumpers are employed only on the other side edge thereof. Because such changes may be made, it is not intended that the scope of the invention be limited to the specific embodiment illustrated and described. Rather, the scope of the invention should be determined by the appended claims and their equivalents.

What is claimed is:

1. A security gate for closing a passageway comprising:

a pair of panels slidably assembled together in overlapping relationship for horizontal motion relative to one another forming an assembly so that an effective width of the assembly can be altered, said panels having first sides that face one another and second sides that face away from one another, each of said panels having an outside vertical frame member with a bumper on that member, a mechanism for increasing the effective width of the assembly for forceably pressing the bumpers against the sides of a passageway, said mechanism including, a horizontal rack on the second side of one of the panels and a handle on the second side of the other of the panels, a shaft connected to and movable with the handle, a brake on the second side of said one panel and having teeth for engaging the rack and preventing the handle and shaft from moving translationally with respect to said one panel when the brake and rack are engaged, and a cam carried by the shaft and disposed between the two panels and a cam follower on said other of the panels and adjacent the cam, said cam acting on the follower to slide the two panels apart for causing the bumpers to engage the sides of the passageway when the cam is moved in response to movement of the handle and the brake engages the rack.

2. A security gate as described in claim 1 wherein each of the outside vertical frame members has more than one bumper.

3. A security gate as described in claim 1 wherein the brake is operatively connected to the shaft and the shaft is operatively connected to the handle and wherein movement of the handle from a first position to a second position causes the brake to engage the rack and wherein movement of the handle from the second position to a third position cause the cam to act on the follower to slide the panels further apart.

4. A security gate as described in claim 3 wherein the handle is rotatably mounted with the shaft.

5. A security gate as described in claim 1 wherein a spring is interposed between the cam and handle enabling the handle to move a limited distance after the panels are prevented from sliding further apart because of firm engagement of the bumpers with the sides of the passageway.

6. A security gate for closing a passageway comprising:

first and second gate panels slidably assembled together so that their combined effective width may be varied to form a barrier for closing passageways of different width, each of said panels having an outside vertical frame member carrying a bumper for engaging the sides of the passageway, and a mechanism for slidably moving the panels with respect to one another to increase their effective width, said mechanism including, a handle pivotally movable on one of the panels between first and second positions, a locking assembly for releasably fixing the pivotal axis of the handle to the panels when the handle is pivoted from the first position to an intermediate position between said first and second positions, said locking assembly enabling the pivotal axis to slide relative to said other of the panels when the handle is in the first position so that the effective width of the panels may be changed, and a cam assembly operable in response to pivotal movement of the handle from the intermediate position to the second position for causing the panels to slide further apart with respect to one another so as to increase the effective width of the gate for causing the bumpers to bear against the sides of the passageway.

7. A security gate as described in claim 6 wherein a spring is interposed between the handle and the cam assembly for enabling the handle to continue to move to the second position after the panels are precluded from sliding further apart.

8. A security gate as described in claim 6 wherein the cam assembly includes a cam rotatably mounted with the handle and a cam follower connected to said one of the panels.

9. A security gate as described in claim 8 wherein a spring is interposed between the handle and cam for enabling the handle to continue to move to the second position after the panels are precluded from sliding further apart.

10. A security gate as described in claim 6 wherein the locking assembly includes a rack on said other of the panels and a brake engageable with the rack and operatively connected to the handle.

11. A security gate as described in claim 10 wherein movement of the handle from the first position to the intermediate position causes the brake to move from a disengaged to an engaged position with respect to the rack.

12. A security gate for closing a passage by bearing against a side thereof comprising:

first and second panels each having an inner and outer vertical side edge, the outer side edge of each panel carrying a bumper, a latching means when engaged releasably locking the two panels together so as to limit the relative translational movement of the panels with respect to one another to a small incremental distance, said latching means enabling the panels to move translationally a substantially greater distance with respect to one another when the latching means is disengaged, and actuating means separate from the latching means and operative for causing the small incremental movement of the panels with respect to one another when the latching means is engaged so as to force the bumpers against the sides of passageway, wherein a handle is operatively connected to the latching means and the actuating means and movable sequentially to a first position wherein the latching means is disengaged, to a second position wherein the latching means is engaged and to a third position wherein the actuating means is operative to cause the small incremental movement.

13. A security gate as described in claim 12 wherein a seat is provided on one of the panels for releasably retaining the handle in the second position.

14. A security gate as described in claim 12 wherein the latching means includes a rack on one panel and a brake operatively connected to the handle.

15. A security gate as described in claim 14 wherein the actuating means includes a cam operatively connected to the handle and a cam follower operatively connected to one of the panels.

16. A security gate as described in claim 12 wherein the actuating means includes a cam operatively connected to the handle and a cam follower operatively connected to one of the panels.

17. A security gate as described in claim 12 wherein a seat is provided on one of the panels for releasably retaining the handle in the second position.

18. A security gate for closing a passage by bearing against a side thereof comprising:

first and second panels each having an inner and outer vertical side edge, the outer side edge of one of the panels carrying a bumper, a latching means when engaged releasably locking the two panels together so as to limit the relative translational movement of the panels with respect to one another to a small incremental distance, said latching means enabling the panels to move translationally a substantially greater distance with respect to one another when the latching means is disengaged, and actuating means separate from the latching means and operative for causing the small incremental movement of the panels with respect to one another when the latching means is engaged so as to force the bumper against the side of passageway, wherein a handle is operatively connected to the latching means and the actuating means and movable sequentially to a first position wherein the latching means is disengaged, to a second position wherein the latching means is engaged and to a third position wherein the actuating means is operative to cause the small incremental movement.

19. A security gate for closing a passageway comprising:

a pair of panels slidably assembled together in overlapping relationship for horizontal motion relative to one another forming an assembly so that an effective width of the assembly can be altered, said panels having first sides that face one another and second sides that face away from one another, each of said panels having an outside vertical frame member with a bumper on that member, a mechanism for increasing the effective width of the assembly for forceably pressing the bumpers against the sides of a passageway, said mechanism including, a horizontal rack on the second side of one of the panels and a handle on the second side of the other of the panels, a shaft connected to and movable with the handle, a brake on the second side of said one panel and having teeth for engaging the rack and preventing the handle and shaft from moving translationally with respect to said one panel when the brake and rack are engaged, and a cam carried by the shaft and disposed between the two panels and a cam follower on said other of the panels and adjacent the cam, said cam acting on the follower to slide the two panels apart for causing the bumpers to engage the sides of the passageway when the cam is moved in response to movement of the handle and the brake engages the rack wherein a spring is interposed between the handle and the cam for enabling the handle to continue to move after the panels are precluded from sliding further apart.

* * * * *